US009512623B1

(12) United States Patent
Prinz et al.

(10) Patent No.: US 9,512,623 B1
(45) Date of Patent: Dec. 6, 2016

(54) INTERLOCKING RUBBER TILES, MATS, BLOCKS AND PAVERS FOR ATHLETIC AND RECREATIONAL SURFACES, PLAYGROUNDS AND ROOFTOPS

(71) Applicant: Unity Creations, Ltd., Saugerties, NY (US)

(72) Inventors: Darren Prinz, New York, NY (US); Erick B. Prinz, Huntington, NY (US)

(73) Assignee: Unity Creations, Ltd., Saugerties, NY (US)

( * ) Notice: Subject to any disclaimer, the term of this patent is extended or adjusted under 35 U.S.C. 154(b) by 0 days.

(21) Appl. No.: 15/045,775

(22) Filed: Feb. 17, 2016

(51) Int. Cl.
*E04F 15/02* (2006.01)
*E04F 15/10* (2006.01)

(52) U.S. Cl.
CPC ... *E04F 15/02177* (2013.01); *E04F 15/02038* (2013.01); *E04F 15/10* (2013.01); *E04F 2201/0138* (2013.01); *E04F 2201/03* (2013.01); *E04F 2201/043* (2013.01); *E04F 2201/07* (2013.01)

(58) Field of Classification Search
CPC ..... E04F 15/00; E04F 15/02; E04F 15/04; E04C 13/00; E04C 13/083; E04C 13/045; E04C 3/006; E04C 11/225
USPC ..... 472/88–92; 52/177, 589.1, 585; 404/40, 404/41, 34, 47, 50
See application file for complete search history.

(56) References Cited

U.S. PATENT DOCUMENTS

| | | | | |
|---|---|---|---|---|
| 2,282,559 | A | 5/1942 | Byers | 52/582.1 |
| 4,715,162 | A | 12/1987 | Brightwell | 52/837 |
| 5,209,541 | A | 5/1993 | Janotik | 296/29 |
| 5,630,304 | A | 5/1997 | Austin | 52/384 |
| 5,971,655 | A | 10/1999 | Shirakawa | 404/40 |
| 6,547,452 | B1 | 4/2003 | Chan et al. | 385/88 |
| 6,766,622 | B1 * | 7/2004 | Thiers | E04F 15/04 144/364 |
| 6,769,218 | B2 * | 8/2004 | Pervan | E04F 15/04 52/591.1 |
| 6,769,835 | B2 | 8/2004 | Stridsman | 404/41 |
| 7,021,012 | B2 | 4/2006 | Zeng et al. | 52/177 |
| 7,114,298 | B2 | 10/2006 | Kotler | 52/177 |
| 7,131,161 | B2 | 11/2006 | Lee | 14/73 |
| 7,331,147 | B2 | 2/2008 | Kalisiak et al. | 52/385 |
| 7,441,384 | B2 * | 10/2008 | Miller | E04F 15/04 52/589.1 |
| 7,571,572 | B2 | 8/2009 | Moller, Jr. | 52/177 |
| 7,591,605 | B2 | 9/2009 | Jonasz et al. | 404/15 |
| 7,793,471 | B2 | 9/2010 | Hill | 52/177 |
| 7,908,802 | B2 | 3/2011 | Frederiksen | 52/177 |
| 8,070,382 | B2 | 12/2011 | Prinz | 404/35 |
| 2012/0124925 | A1 | 5/2012 | Prinz et al. | 52/302.1 |

* cited by examiner

*Primary Examiner* — Kien Nguyen
(74) *Attorney, Agent, or Firm* — Gerald T. Bodner

(57) ABSTRACT

A tile for covering an area which interlocks with an adjacent tile includes a main body having a top surface and a bottom surface disposed opposite the top surface. The main body has at least a first lateral side and a second lateral side. The tile includes a plurality of spaced apart male connectors situated on the first lateral side, and a plurality of spaced apart female receptacles situated on the second lateral side. The tile further includes a plurality of spaced apart wedge-shaped projections and a plurality of spaced apart complementary-shaped slots. Each slot is situated on either the first lateral side or the second lateral side of the main body in between either adjacent male connectors or adjacent female receptacles. Similarly, each projection is situated either on the first lateral side or the second lateral side of the main body in between either adjacent female receptacles or adjacent male connectors. The male connectors of the tile are engageable with female receptacles of an adjacent tile so that the tile may interlock with the adjacent tile. Also, the projections of the tile are receivable by slots of the adjacent tile to help prevent the tiles from curling, separating and/or peeling.

9 Claims, 14 Drawing Sheets

Fig. 1
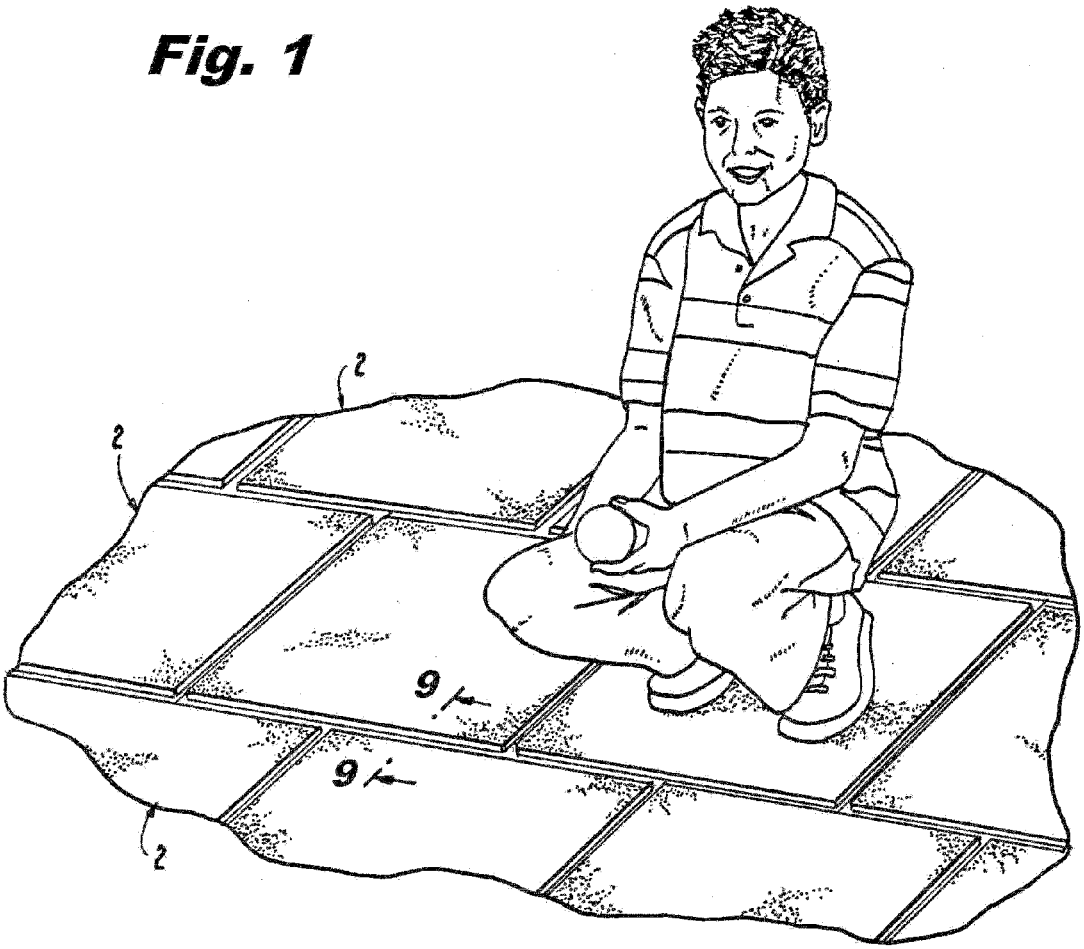
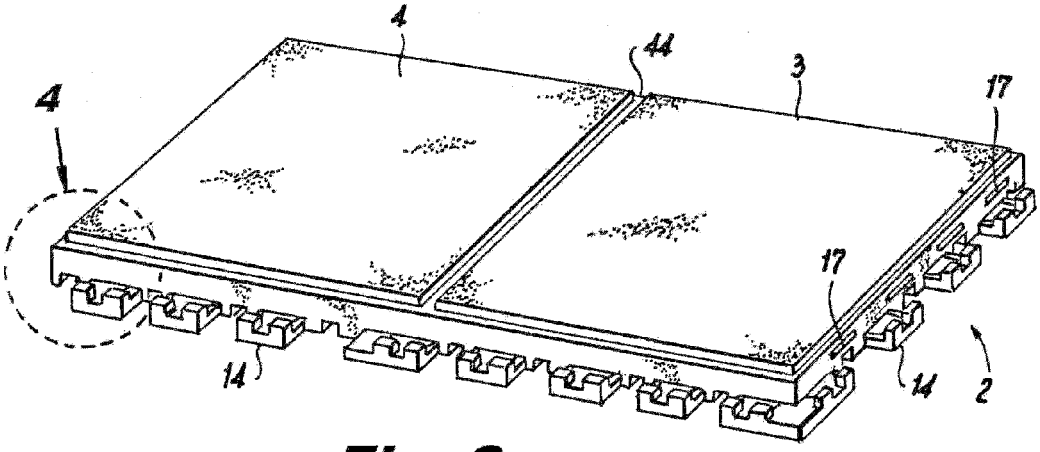
Fig. 2

INTERLOCKING RUBBER TILES, MATS, BLOCKS AND PAVERS FOR ATHLETIC AND RECREATIONAL SURFACES, PLAYGROUNDS AND ROOFTOPS

BACKGROUND OF THE INVENTION

Field of the Invention

This invention generally relates to protective padding and more particularly relates to recycled protective tiling.

Description of the Prior Art

The most common injuries at recreational facilities such as playgrounds and athletic or sporting arenas are attributed to falls. Such injuries include head trauma, fractures and sprains, some leaving long term disability. Children very often run on concrete slabs or loose gravel, while others play on swings, carrying them high above the ground. During incidents in which the child loses control or balance, the ground material can prove to be very unforgiving.

Conventional methods of minimizing injury from falls include padding the ground with dense material such as closed cell foam. This type of padding commonly comes in lengthy sheets that are cut to size. The sheets are placed over the ground, regardless of the composition. For example, closed cell foam pads are often placed over loose gravel in the same manner that they are placed over concrete slab. Unfortunately, the underlying ground material can affect the overall effectiveness of the protective padding.

Closed cell foam pads most typically have a planar bottom and top without any recesses. While this conventional design provides means for effectively positioning and maintaining coverage of a concrete slab, if the same foam pad is placed on loose gravel or rocks, it will not be secured and may cause further personal injury from movement of the protective covering. Additionally, when closed cell foam pads are placed on uneven surfaces such as gravel, rooftop membranes, the foam pads take the shape of the underlying surface, creating an uneven activity area that may provoke falls from tripping. Conventional closed cell foam padding also tends to become slippery when wet from inclement weather or nearby sprinklers as water commonly pools on the flat surface thereof.

There are also conventional tiles available that are made from reprocessed or recycled rubber, for example, from shredded rubber automobile tires. However, such conventional tiles do not interlock with one another and may separate, curl, peel or buckle, leaving either an exposed area of the supporting surface on which the tiles are laid, or an uneven surface, which may cause injury to a child or person playing on the tiled surface. Also, if conventional non-interlocking tiles are installed on a rooftop, they may be unsafe and may cause injury because of the potential flight characteristics of such tiles resulting from high wind conditions.

When conventional tiles are placed next to each other, even if they were somehow glued together, there may be a tendency for the tiles to separate, curl and/or peel at their edges, possibly caused by temperature fluctuations or use. Such curling may result in an uneven surface and may cause injury to a person walking or running thereon.

A viable solution to the design flaws of conventional tiles is disclosed in U.S. Patent Application Publication No. 2012/0124925 and entitled "Interlocking Rubber Tiles for Playgrounds," the disclosure of which is incorporated herein by reference. The aforementioned published application discloses a tile that may be interlocked with adjacent tiles to cover an area, such as a playground or rooftop. The design utilizes not only a plurality of male connectors and female receptacles positioned on the lateral sides of the tile that are engageable with one another so that adjacent tiles may be interlocked, but also a plurality of elongated projections spaced apart from each other and situated on one or more lateral sides of a tile, and elongated slots spaced apart from each other which are positioned on one or more lateral sides of an adjacent tile so that the projections of one tile may be received by the slots of an adjacent tile. Glue may be used to hold each elongated projection in a respective slot.

Although the projections and slots disclosed in the aforementioned '925 published application works well to prevent the interlocked tiles from curling at their edges, it is sometimes difficult to force the projections of one tile into respective slots of an adjacent tile when the tiles are tightly arranged so that there is little or no gap between adjacent tiles. It is possible that, by applying a downward force on the tiles to cause them to interlock, the projections of one tile may be sheared off or damaged, or may not fully seat properly in a respective slot of an adjacent tile, the result being a weakened anti-curling connection between adjacent tiles.

OBJECTS AND SUMMARY OF THE INVENTION

It is an object of the present invention to provide rubberized tiles (which also include rubberized mats, blocks and pavers) for use in covering sports and recreational areas, playgrounds or the like, as well as rooftops, which interlock with one another.

It is another object of the present invention to provide rubberized, interlocking tiles which include structure that acts as a reservoir for containing glue to adhesively join adjacent tiles together.

It is still another object of the present invention to provide rubberized tiles which interlock with one another, and which include structure that acts as a reservoir for containing glue to adhesively join adjacent tiles together, and further include structure that allows excess glue to be removed from the reservoir.

It is yet a further object of the present invention to provide interlocking tiles that include structure which helps minimize separation, curling and peeling of the edges of the tiles.

It is yet another object of the present invention to provide interlocking tiles for use with athletic and recreational areas, playgrounds, rooftop surfaces and the like made from reprocessed or recycled rubber which overcome the inherent disadvantages of known tiles.

It is still another object of the present invention to provide interlocking tiles which may be installed on rooftops and which satisfy wind uplift criteria.

In accordance with one form of the present invention, a tile for covering an area and which interlocks with an adjacent tile includes a main body having a top surface and a bottom surface disposed opposite the top surface. The main body has at least a first lateral side and a second lateral side.

The tile includes at least one male connector situated on at least one of the first lateral side and the second lateral side of the main body and extending outwardly therefrom. The tile further includes at least one female receptacle situated on at least one of the first lateral side and the second lateral side of the main body.

The male connector of the tile is engageable with a female receptacle of an adjacent tile so that the tile may interlock with the adjacent tile.

Preferably, the male connector and the female receptacle include structure defining a reservoir for containing an adhesive for adhesively securing the tile and an adjacent tile together.

The tile further includes structure defining at least one generally wedge-shaped slot or recess situated on at least one of the first and second lateral sides of the main body. The tile also includes at least one corresponding generally wedge-shaped projection situated on a opposite lateral side of the tile from where the at least one slot is located. The wedge-shaped projections of the tile are received by corresponding wedge-shaped slots of an adjacent tile.

More specifically, each projection of one tile may include an inverted triangular or ramp-like sloped entrance surface which is received in a complementary-shaped recess of an adjacent tile. The sloped entrance surface, either triangular or ramp-like in shape, on each projection of one tile allows the tile to be forced downwardly in close side-by-side proximity to an adjacent tile without causing the projection to be sheared off or damaged when doing this. Each projection preferably includes a flat upper surface, extending outwardly from a lateral side of the tile on which it is mounting and situated opposite the sloped entrance surface. The complementary-shaped recess of an adjacent tile into which the projection is received also is defined with a flat top wall. When the two adjacent tiles are mated together using a downward force on one tile, the sloped entrance surfaces of the projections pass beyond the top surface of the adjacent tile and into their respective complementary-shaped recesses of the adjacent tile. When the flat upper surfaces of the projections pass the flat top walls of the recesses, the projections are locked into place within their respective recesses to prevent the tiles from separating, curling, peeling or lifting relative to one another along their lateral sides.

These and other objects, features and advantages of the present invention will be apparent from the following detailed description of illustrative embodiments thereof, which is to be read in connection with the accompanying drawings.

BRIEF DESCRIPTION OF THE DRAWINGS

FIG. 1 is a perspective view of the interlocking tiles of the present invention joined together to form a protective surface for playgrounds, rooftops and the like.

FIG. 2 is a perspective view of the tile formed in accordance with the present invention.

DETAILED DESCRIPTION OF THE PREFERRED EMBODIMENTS

Figure 3:
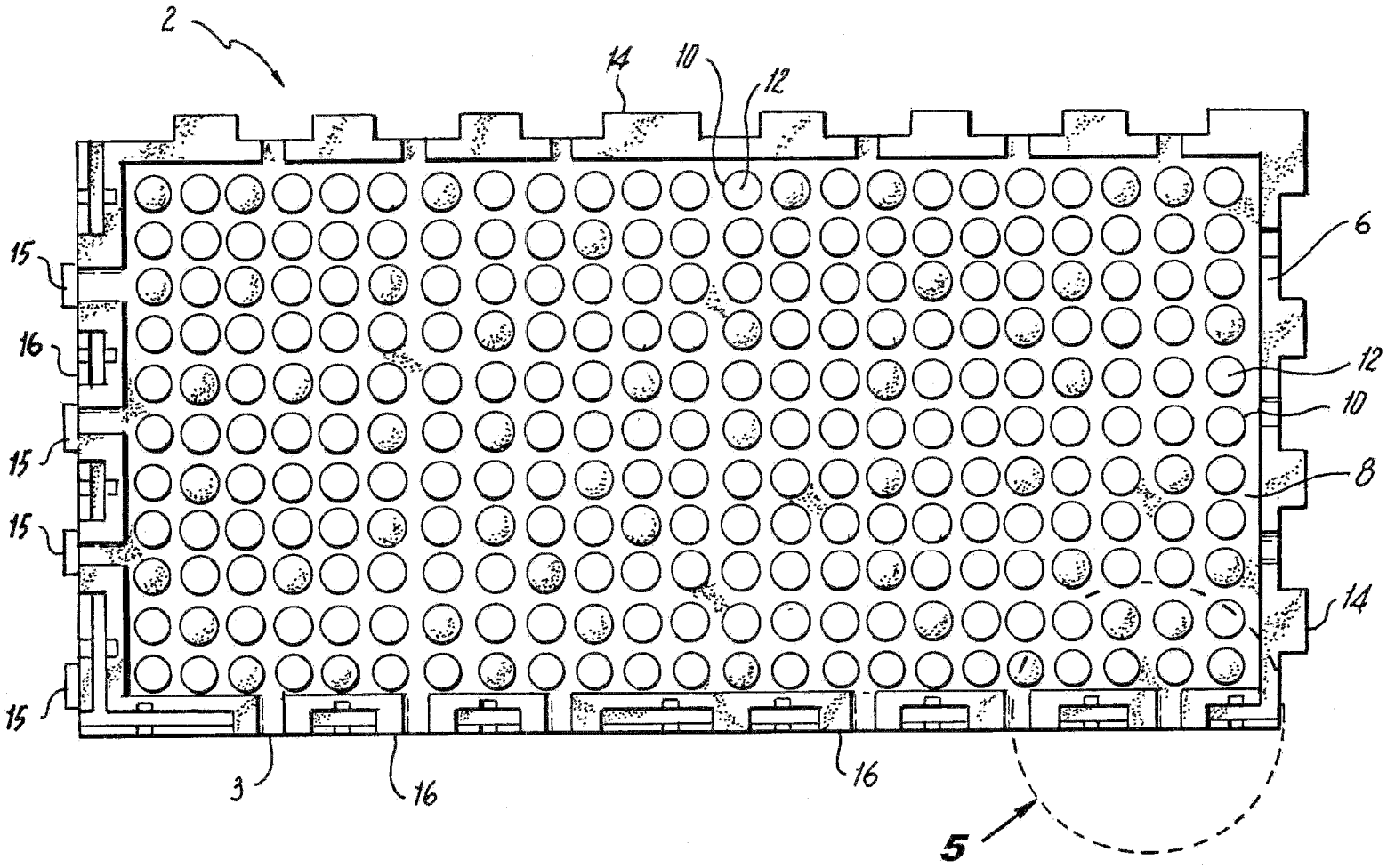
FIG. 3 is a bottom plan view of a tile formed in accordance with the present invention.
Figure 4:
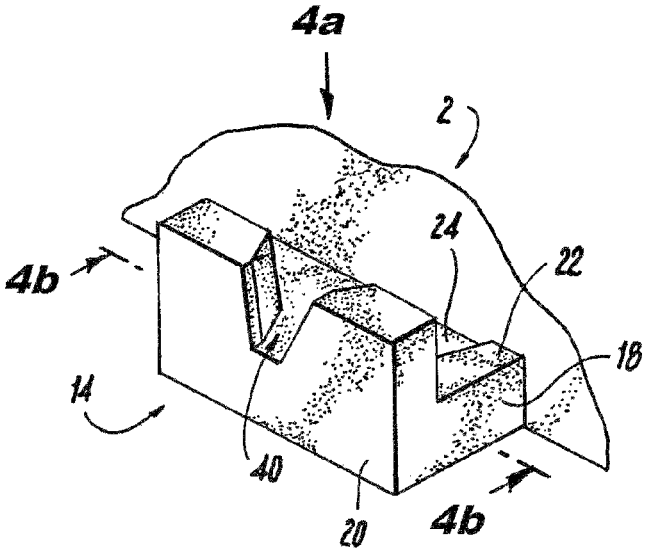
FIG. 4 is a perspective view of a portion of the tile of the present invention shown encircled in FIG. 2, and illustrating a male connector of the tile used for interlocking adjacent tiles together.
Figure 4A:
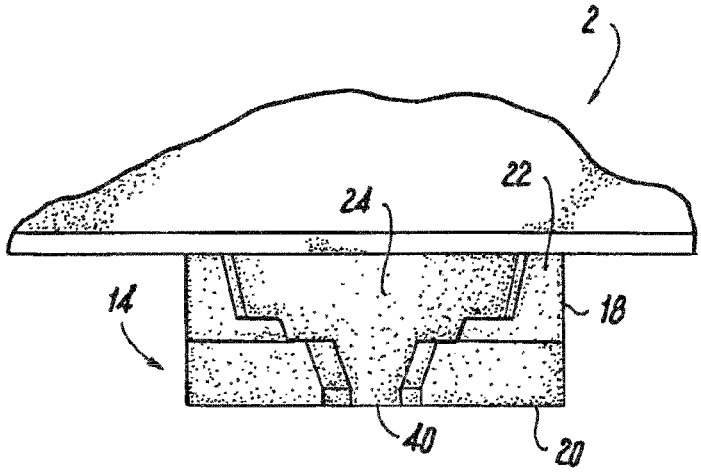
FIG. 4*a* is a top plan view of a portion of the tile of the present invention, and illustrating the male connector shown in FIG. 4.
Figure 4B:
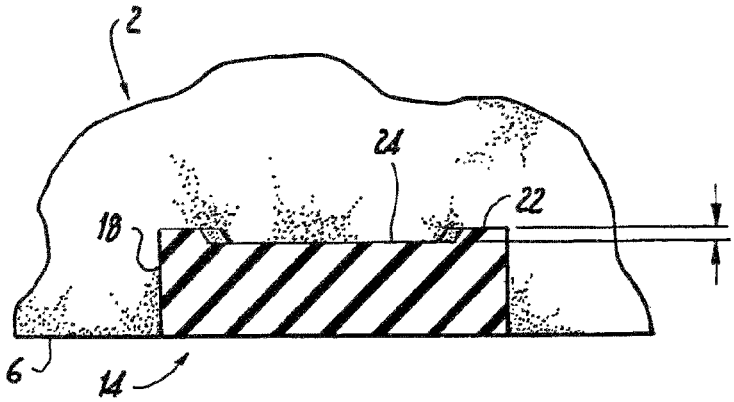
FIG. 4*b* is a cross-sectional view of a portion of the tile formed in accordance with the present invention and, in particular, the male connector thereof, taken along line 4*b*-4*b* of FIG. 4.
Figure 5:
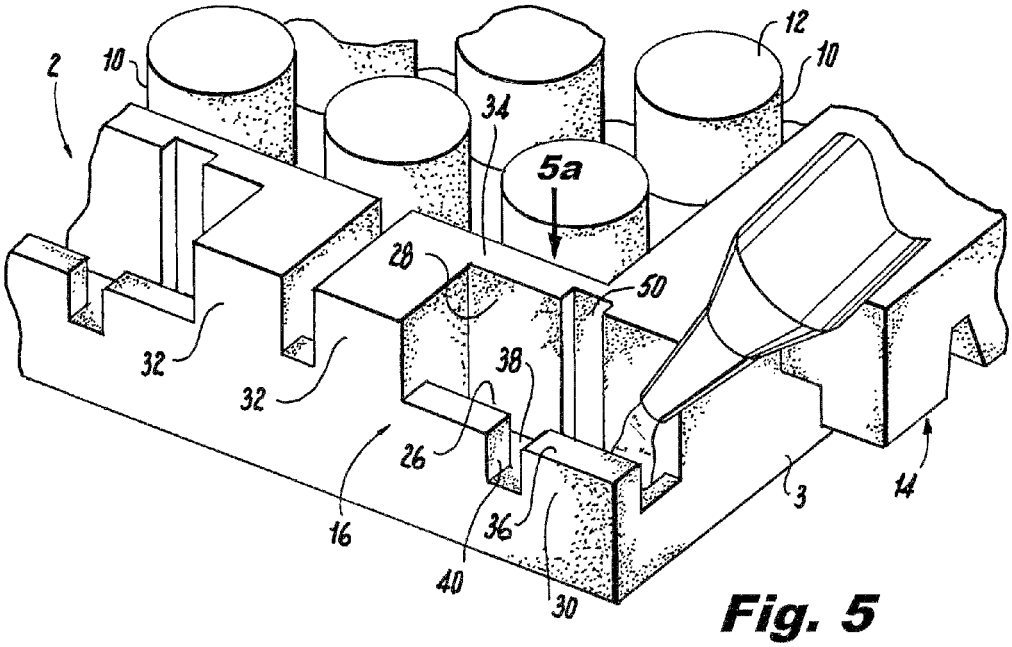
FIG. 5 is a perspective view of a portion of the underside of the tile formed in accordance with the present invention shown encircled in FIG. 3, and illustrating a female receptacle of the tile used for interlocking adjacent tiles together.
Figure 5A:
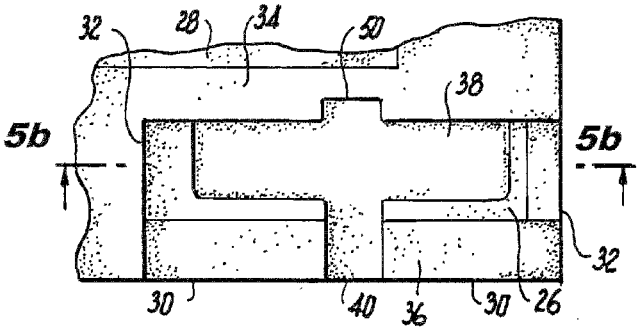
FIG. 5*a* is a top plan view of a portion of the tile of the present invention, and illustrating the female receptacle shown in FIG. 5.
Figure 5B:
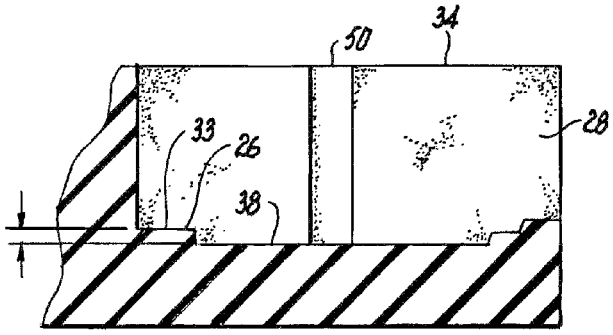
FIG. 5*b* is a cross-sectional view of a portion of the tile of the present invention, and illustrating the female receptacle of the tile, taken along line 5*b*-5*b* of FIG. 5*a*.
Figure 6:
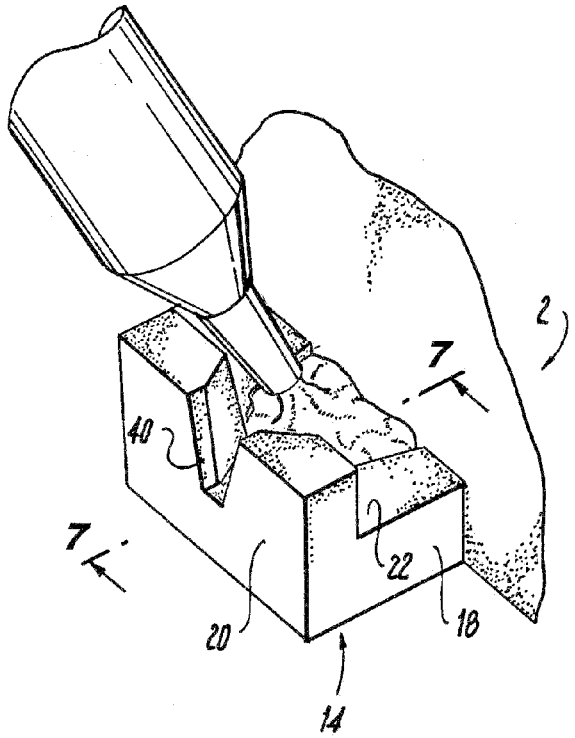
FIG. 6 is a perspective view of a portion of the tile of the present invention, and illustrating a liquid adhesive being applied to a male connector thereof.
Figure 7:
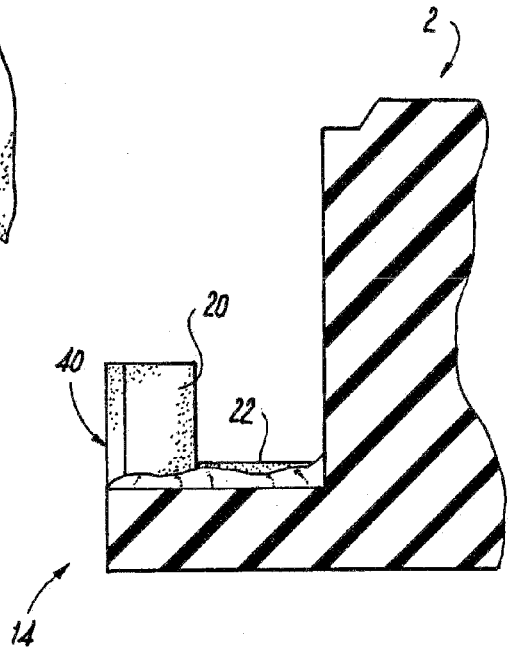
FIG. 7 is a cross-sectional view of a portion of the tile of the present invention and, in particular, the male connector of the tile, taken along line 7-7 of FIG. 6.
Figure 8:
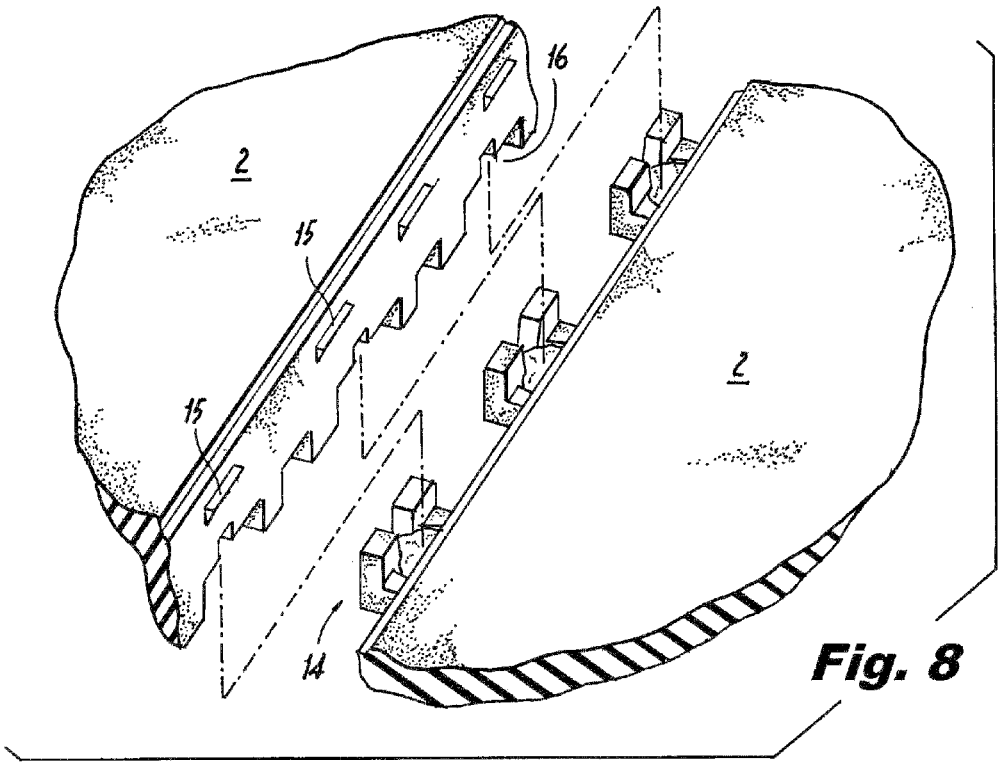
FIG. 8 is an exploded perspective view of portions of two adjacent tiles of the present invention, and illustrating the joining of the two tiles together.
Figure 9:
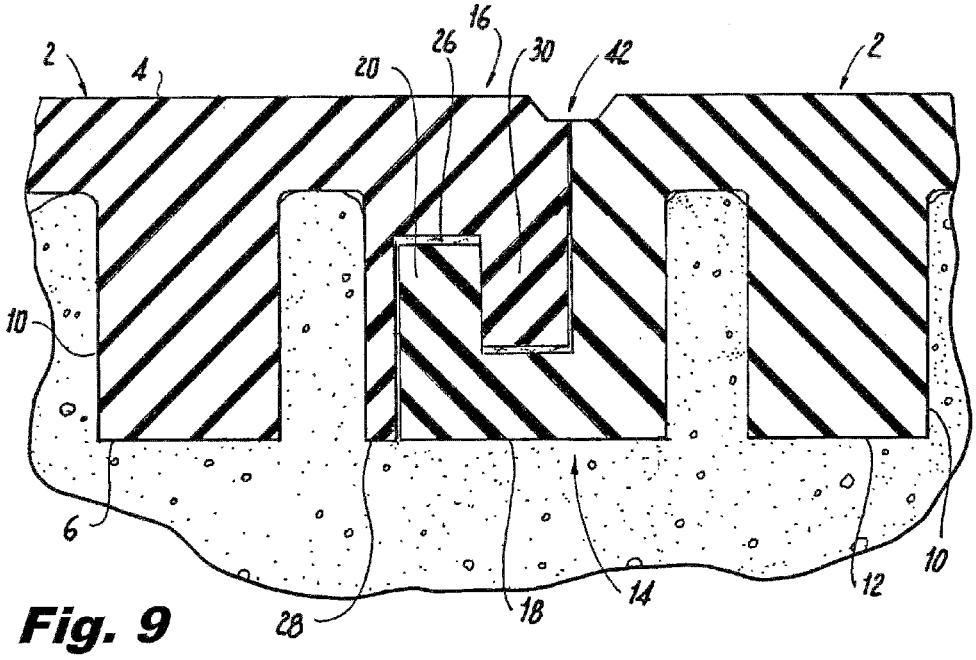
FIG. 9 is a cross-sectional view of portions of two joined together tiles of the present invention.

Referring to FIGS. 1-9 of the drawings, it will be seen that a rubber tile protective system constructed in accordance with a first embodiment of the present invention includes a plurality of rubber tiles 2, each rubber tile 2 being interconnectable to another by a series of interlocking mechanisms integrated along the peripheral edges of each tile. The rubber tiles 2 may be selectively coupled by the interlocking mechanisms to one another to form a customizable protective surface of various proportion and size, depending on the specific application and area to be protected.

Each tile 2 may be formed in a plurality of shapes and sizes, but preferably is rectangular. The tile 2 includes a main body 3 residing generally in a plane and having a top surface 4 having a high coefficient of friction for providing sufficient traction to children and other users. The main body 3 of the tile 2 also includes an oppositely disposed bottom surface 6, the bottom surface 6 being laid on and resting on the ground or other supporting surface and having a recessed portion 8 formed therein. A plurality of cylindrical stanchions 10 extending downwardly and outwardly from the recessed portion 8, the end face 12 of each stanchion 10 being coplanar with the bottom surface 6 of the tile 2, provide gripping means to resist movement of the tile 2 when the ground surface consists of loose materials such as gravel, pebbles or shale. More specifically, when the tiles 2 are placed on a ground surface consisting of loose materials, the loose ground material may fill the recessed area around the stanchions 10 and the stanchions 10 may anchor the tile 2 in place. Each end face 12 of the stanchions 10 defines a flat bottom surface that is co-planarly aligned with the bottom surface 6 of the tile 2 to provide a large surface area to grip flat ground materials such as concrete slab.

Along the periphery of the main body 3 of the rubber tiles 2 are situated a plurality of interlocking mechanisms comprising a male connector 14 and a mating female receptacle 16. More specifically, along a first lateral side and neighboring second lateral side of the main body 3 of the tile 2 are extending outwardly therefrom a series of male connectors 14. Disposed oppositely of the male connectors 14, along a third lateral side and neighboring fourth lateral side of the main body 3, are extending outwardly therefrom a series of female receptacles 16. Individual rubber tiles 2 may be joined together by cooperatively mating the male connectors 14 on the first and second lateral side of a first tile 2 with the female receptacles 16 on the third or fourth lateral side of a second tile. To provide structural support, the tiles 2 are preferably joined together in a staggered manner, as shown in FIG. 1.

Now referring to FIGS. 3, 4, 4*a*, 6 and 7 of the drawings, it can be seen that each male connector 14 is formed as an L-shaped member extending perpendicularly outwardly from the side of the tile 2. The male connector 14 includes a horizontally disposed first segment 18, which extends co-planarly with the main body 3, and a vertically disposed second segment 20, the second segment 20 extending perpendicularly from the first segment 18. The first segment 18 further includes a top surface 22 having a glue reservoir 24 formed as a recess therein for receiving liquid adhesive. A plurality of male connectors 14 are preferably formed in series along the first and second sides of the tile 2, the connectors 14 preferably being equidistant from one another.

The female receptacles 16, as illustrated in FIGS. 3, 5, 5*a* and 5*b* of the drawings, are formed as rectangular recesses 26 within the bottom surface 6 of the tile 2, along the third and fourth sides thereof. The recesses 26 are defined by an inner wall 28, an oppositely disposed outer wall 30, two side walls 32 and a recessed surface 33. The inner wall 28 is connected to the oppositely disposed outer wall 30 by the two side walls 32, the inner wall 28 extending from the recessed portion 8 of the bottom surface 6 and terminating in an end wall 34 that is coplanar to the bottom surface 6, and the outer wall 30 extending from the recessed surface 33 of the female receptacle 16 and terminating in an end wall 36, the outer wall 30 being shorter than the inner wall 28 to accommodate and engage the horizontal first segment 18 and top surface 22 thereof of an aligned male connector 14 of an adjacent tile 2. The female receptacles 16 are preferably formed in series along the third and fourth sides of the tile 2, each female receptacle 16 preferably being positioned opposite from its corresponding male connector 14 on the first and second sides. The recesses 26 cooperatively receive the vertical second segment 20 of the male connector 14, mating the male connector 14 and the female receptacle 16 and interlocking neighboring tiles 2. The recessed surface 33 (within the recess 26) of each female receptacle 16 also has formed therein a glue reservoir 38 as a recess for receiving liquid adhesive, the glue reservoir 38 being similar in shape to the glue reservoir 24 formed in the male connector 14.

Each of the outer wall 30 of the female receptacle 16 and the vertical second segment 20 of the male connector 14 further includes a vertically disposed slot 40, which slots 40 are aligned with one another when the connector 14 is received by the receptacle 16. The vertical slot 40 of the vertical second segment 20 of the male connector 14 is in fluid communication with the glue reservoir 24 formed in the male connector 14 to allow excess adhesive filling the reservoir to flow through the vertical slot 40 from the male connector 14. Similarly, the vertical slot 40 of the outer wall 30 of the female receptacle 16 is in fluid communication with the glue reservoir 38 formed in the female receptacle 16 to allow excess adhesive filling the reservoir 38 to flow through the vertical slot 40 from the female receptacle 16.

Each inner wall 28 of the female receptacles 16 further includes a vertically disposed channel 50 formed therein, as shown in FIGS. 5, 5*a*, 5*b* and 16. The vertical channel 50 of each inner wall 28 extends from the glue reservoir 38 of the female receptacle 16 through the end wall 34 thereof. Each vertical channel 50 of each inner wall 28 is in communication with the glue reservoir 38 and recess 26 fonned in the female receptacle 16 to allow excess adhesive filling the reservoir 38 to flow through the vertical channel 50 from the female receptacle 16, especially when two tiles are joined together and placed right-side up. In a preferred embodiment, the vertical channel 50 of the inner wall 28 is oppositely situated to the vertical slot 40 of the outer wall 30 of each female receptacle 16.

Prior to interlocking two neighboring tiles 2, a liquid adhesive is applied to one or both of the horizontal first segment 18 and/or glue reservoir 24 of each male connector 14 and the recess 26 and/or glue reservoir 38 of each female receptacle 16. As the aligned male connector 14 and female receptacle 16 of adjacent tiles 2 are mated and pressure is applied, the aligned vertical slots 40 in the outer wall 30 of the female receptacle 16 and the vertical second segment 20 of the male connector 14 create a path for excess adhesive to exit the glue reservoirs 24, 38 of the male connectors 14 and female receptacles 16 and the sides of the joined together tiles 2. Excess glue will also escape the female receptacle 16 through the channel 50 formed in the inner wall 28 of the female receptacle 16 and will flow downwardly towards the ground and away from the top surface of the tile when the tiles are joined together and positioned with the top surface properly facing upwardly. Thus, the channels 40, 50 will help minimize or prevent any adhesive from adhering to the top surface of the tile, which would otherwise have required its removal therefrom, which is difficult to do because of the rough surface texture of the tile. The adhesive secures the vertical second segment 20 of the male connector 14 within the recess 26 of the female receptacle 16 and preferably secures the top surface 22 of the horizontal first segment 18 of the male connector 14 to the end wall 36 of the outer wall 30 of the female receptacle 16.

The top surface 4 of each tile 2 preferably further includes a plurality of water channels 42. The water channels 42 are preferably formed as chamfers along the top peripheral edges of the tile 2. As neighboring tiles 2 are interlocked, their facing peripheral chamfered edges create such a recess or channel 42 that allows water to run off the top surface 4 of the tile 2 into the channel 42, minimizing water pooling. Additional water channels 44 may be formed as elongated recesses in the top surface 4, each being in fluid communication with an aforementioned peripheral water channel 42.

Figure 12:
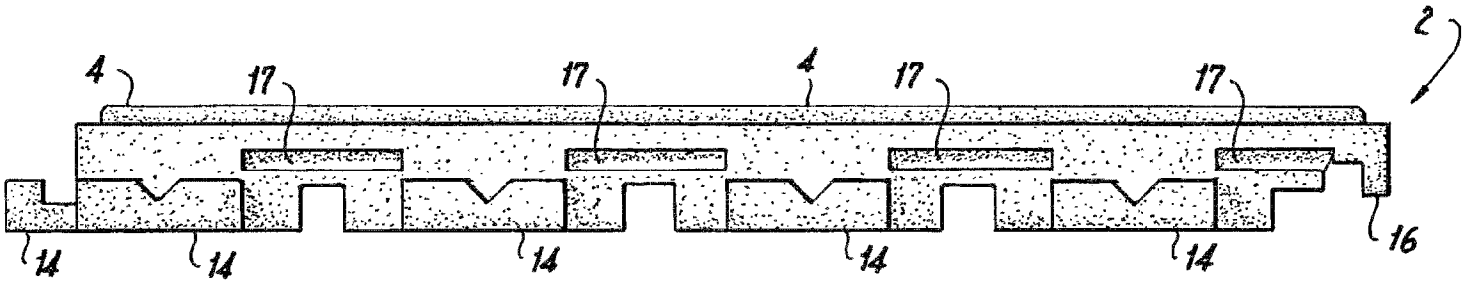
FIG. 12 is a right elevational view of the tile of the present invention shown in FIG. 10, showing the tile with side slots.

Referring to FIGS. 10-19 of the drawings, it can be seen that the rubber tile protective system of the present invention also preferably includes a plurality of interconnectable rubber tiles 2, each tile 2 having a main body 3, a top surface 4, a bottom surface 6, a plurality of cylindrical stanchions 10, and a plurality of interlocking mechanisms comprising a male connector 14 and a mating female receptacle 16. Furthermore, as can be seen in FIGS. 10-13, 16, 17 and 20-23 of the drawings, the tile 2 includes one or more generally wedge-shaped slots or recesses 17 formed in at least one lateral side thereof, and one or more generally wedge-shaped projections 15 formed on at least another lateral side of the tile 2 which is preferably situated opposite the side having the slot or slots 17 formed therein. In a preferred form, the tile 2 includes a plurality of generally wedge-shaped slots 17 spaced apart from each other, each slot being positioned on a side of the tile between adjacent male connectors 14, as shown in FIG. 12 of the drawings. Alternatively, one or more generally wedge-shaped projections 15 may be situated on this side between the male connectors 14 instead of the slots 17.

Figure 13:
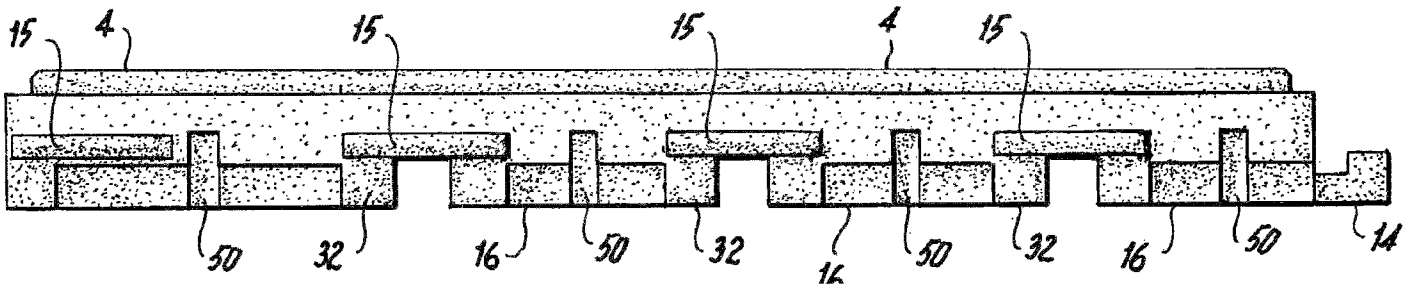
FIG. 13 is a left elevational view of the tile of the present invention shown in FIG. 10, showing the tile with side projections.

Correspondingly, in this preferred form, the tile 2 includes a plurality of generally wedge-shaped projections 15 spaced apart from each other, each projection being positioned on a side of the tile that is preferably opposite the side having the generally wedge-shaped slots 17, as shown in FIG. 13 of the drawings. Each projection 15 is preferably situated on the side between adjacent female receptacles 16. Alternatively, one or more generally wedge-shaped slots 17 may be situated on this side between the female receptacles 16 instead of the projections 15.

The slots 17 and projections 15 are preferably complementary in shape so that the projections may be received by the slots. However, it is envisioned to be within the scope of the present invention for the slot 17 to have any general shape that allows it to at least partially receive the generally wedge-shaped projection 15. In a preferred embodiment of the present invention, the projections 15 preferably include an upper portion 60 and a lower portion 62 disposed opposite the upper portion 60, and at least two opposite lateral side walls 61. Preferably, the upper portion 60 and lower portion 62 are asymmetrical to one another. More specifically, the projections 15 are preferably wedge-shaped and the slots 17 are preferably formed as complementary wedge-shaped recesses.

Referring to FIGS. 20-23 of the drawings, it can be seen that the upper portion 60 of the projection 15 is preferably generally rectangular in shape having a flat top side 64 situated between the lateral sides 61 and preferably extending perpendicularly outwardly from the outer surface of the lateral side of the tile on which the projection 15 is situated and below the top surface of the tile. The lower portion 62 is preferably tapered or sloped on three sides, that is, opposite lateral sides 62*a* and 62*b*, and the front side 62*c*, so that the projection 15 has a generally wedge shape. The three sides 62*a*, 62*b*, 62*c* of the lower portion 62 converge to a point or apex A located equi-distant from the lateral sides 61 of the projection 15 and on or near the surface of the tile from which the projection 15 protrudes. Correspondingly, in this preferred form, the complementary-shaped slots 17 are formed with an upper recess portion 66 and a lower recess portion 68 disposed opposite the upper recess portion 66. The upper recess portion 66 of the slot 17 is preferably generally rectangular in shape so as to complement the shape of the upper portion 60 of the projection 15, which is in alignment therewith when the projection 15 of one tile is received by a corresponding slot 17 of an adjacent tile. The upper recess portion 66 of the slot 17 is formed with a flat top wall 67 which extends preferably perpendicularly into the tile from the outer surface of the lateral side of the tile on which the slot 17 is formed and is positioned below the top surface of the tile to form a lip 63 therewith. The lower recess portion 68 is preferably tapered or sloped in shape to complement the shape of the lower portion 62 of the projection 15, having opposite lateral side surfaces 68*a* and 68*b*, and a front surface 68*c*, which are in alignment with sides 62*a*, 62*b* and 62*c*, respectively, of the lower portion 62 when the projection 15 of one tile is received by a corresponding slot 17 of an adjacent tile.

Figure 22:
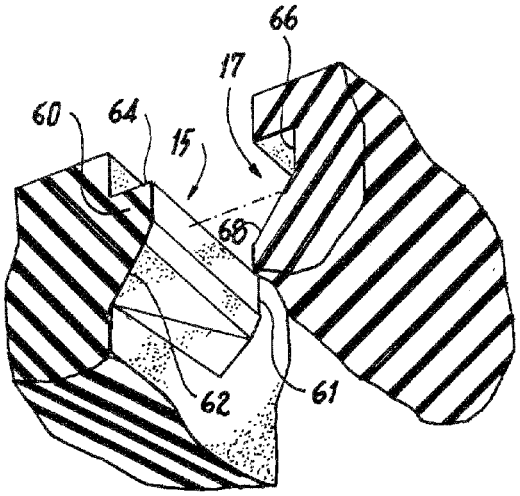
FIG. 22 is a cross-sectional perspective view of portions of adjacent tiles formed in accordance with the present invention, and illustrating the projection and slot shown in FIGS. 20 and 21 mated together.
Figure 23:
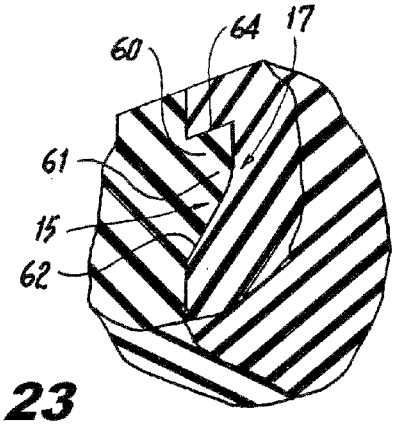
FIG. 23 is a cross-sectional, exploded, perspective view of portions of adjacent tiles formed in accordance with the present invention, and illustrating the projection and the slot shown in FIGS. 20 and 21 separated from each other.
Figure 25:
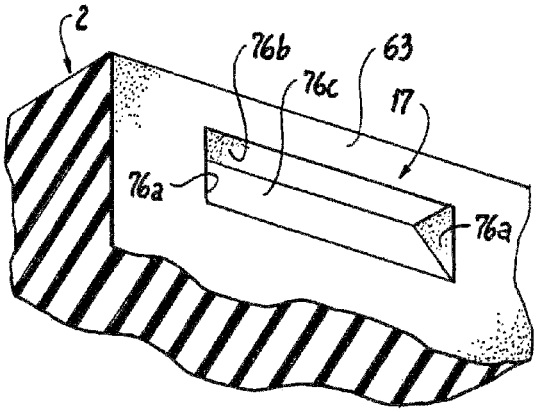
FIG. 25 is a perspective view of a portion of the tile formed in accordance with the present invention and showing a second form of a slot formed thereon for receiving the tile projection shown in FIG. 24.
Figure 24:
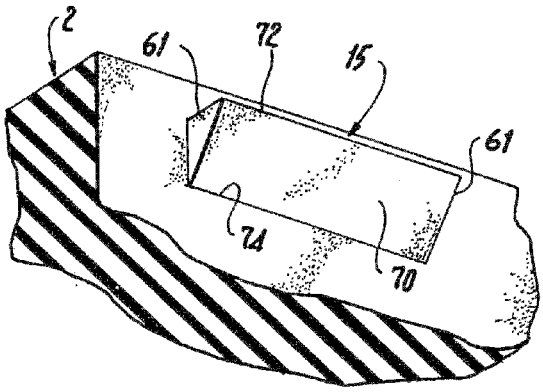
FIG. 24 is a perspective view of a portion of the tile formed in accordance with the present invention and showing a second form of a projection formed thereon for preventing curling of a lateral side of the tile.
Figure 26:
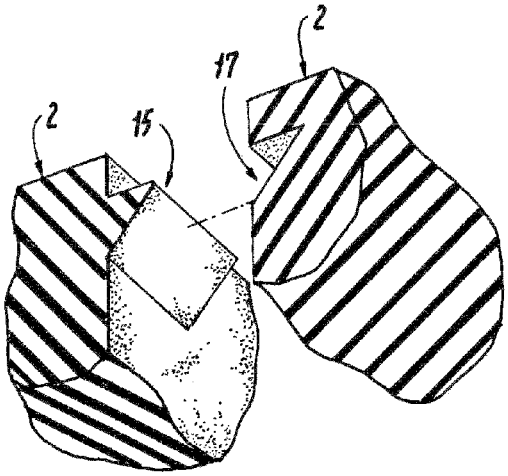
FIG. 26 is a cross-sectional perspective view of portions of adjacent tiles formed in accordance with the present invention, and illustrating the projection and slot shown in FIGS. 24 and 25 mated together.
Figure 27:
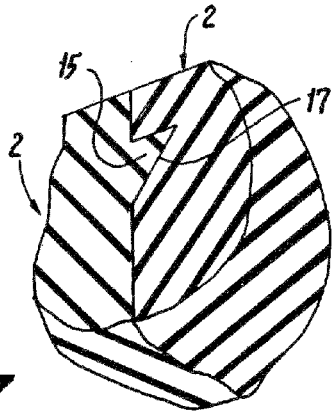
FIG. 27 is a cross-sectional, exploded, perspective view of portions of adjacent tiles formed in accordance with the present invention, and illustrating the projection and the slot shown in FIGS. 24 and 25 separated from each other.
Figure 29:
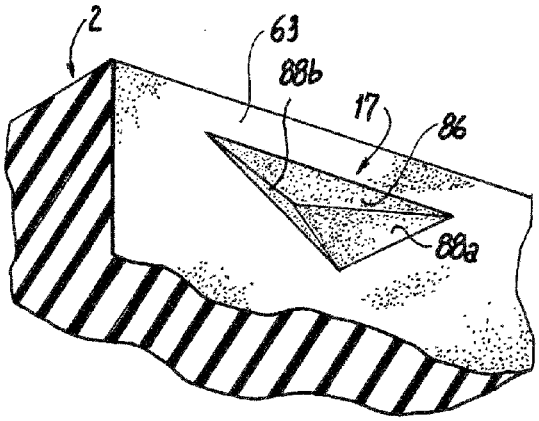
FIG. 29 is a perspective view of a portion of the tile formed in accordance with the present invention and showing a third form of a slot formed thereon for receiving the tile projection shown in FIG. 28.
Figure 28:
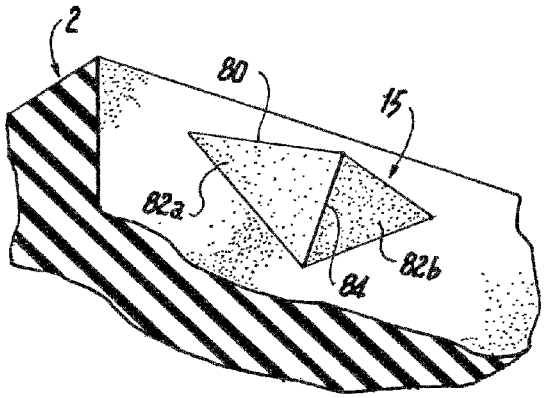
FIG. 28 is a perspective view of a portion of the tile formed in accordance with the present invention and showing a third form of a projection formed thereon for preventing curling of a lateral side of the tile.
Figure 30:
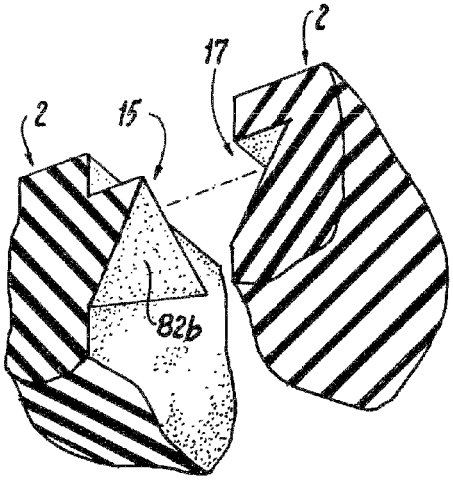
FIG. 30 is a cross-sectional perspective view of portions of adjacent tiles formed in accordance with the present invention, and illustrating the projection and slot shown in FIGS. 28 and 29 mated together.
Figure 31:
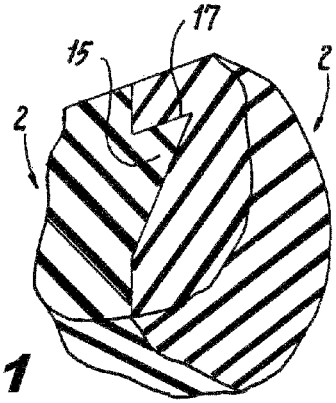
FIG. 31 is a cross-sectional, exploded, perspective view of portions of adjacent tiles formed in accordance with the present invention, and illustrating the projection and the slot shown in FIGS. 28 and 29 separated from each other.

When two tiles 2 are placed adjacent one another, with the side of one tile which includes projections 15 facing the side of the other tile which includes slots 17, the projections 15 and slots 17 should be positioned on their respective sides so that they are in alignment and may mate with one another, the projections 15 of one tile being received by corresponding slots 17 of the other tile, as can be seen in FIGS. 22 and 23 of the drawings. More specifically, the sloping sides 62*a*, 62*b* and 62*c* of the projection 15 together define an inverted triangular sloped entrance surface which may be more easily received in a complementary-shaped recess or slot 17 of an adjacent tile. The sloped entrance surface on each projection of one tile allows the tile to be forced downwardly in close side-by-side proximity to an adjacent tile without causing the projection 15 to be sheared off or damaged when doing this. The projection 15, being formed of the same material as the rest of the tile on which it is mounted, which is preferably a rubberized material, has some resiliency, and this resiliency aides in allowing the projection 15 to pass beyond the top surface of an adjacent tile and into a complementary-shaped recess 17 of the adjacent tile.

When two adjacent tiles are mated together using a downward force on one tile, the sloped entrance surfaces of the projections 15 pass beyond the top surface and slot lip 63 of the adjacent tile and into their respective complementary-shaped recesses or slots 17 of the adjacent tile. When the flat top side 64 of the projections 15 passes the flat top wall 67 defining part of the upper recess portion 66 of the slots 17, the projections 15 are locked into place within their respective recesses or slots 17 by the projection top sides 64 engaging the slot top walls 67 to prevent the tiles from lifting relative to one another along their lateral sides.

Another version of the projections 15 and complementary-shaped recesses 17 formed on the tiles is shown in FIGS. 24-27 of the drawings. It will be seen from these figures that each projection 15 includes opposite lateral sides 61 which extend outwardly preferably perpendicularly from the lateral side of the tile on which the projection 15 is mounted, a flat top side 72 extending between the lateral sides 61 and also outwardly and preferably perpendicularly from the lateral side of the tile, and a ramp-like sloping surface 70 which slopes downwardly from the outermost edge of the flat top side 72 of the projection 15 and inwardly toward the lateral side of the tile on which the projection 15 is mounted on the lowermost end 74 of the projection 15. Similarly, in this embodiment, the slot or recess 17 is formed with a complementary shape to that of the projection 15 in the lateral side of the tile, and defined with opposite lateral walls 76*a*, a flat top wall 76*b* preferably extending inwardly of the lateral side of the tile in which it is formed and perpendicularly to the outer surface of the lateral side of the tile and between the two opposite lateral walls 76*a* of the recess or slot 17, and a sloped back wall 76*c* which extends from the inner end of the flat top wall 76*b* towards the surface of the lateral side of the tile in which the recess or slot 17 is formed.

In a similar manner to the projections 15 and recesses or slots 17 shown in FIGS. 20-23, the projections 15 shown in FIGS. 24-27 of one tile are received by the complementary-shaped recesses or slots 17 of an adjacent tile situated in alignment with the projections 15. The ramp-like sloped front side 70 of the projections 15 defines a sloped entrance surface which aids in the projections 15 of one tile being received by the recesses or slots 17 of an adjacent tile when a downward force is exerted on the tile with the projections 15. Again, like the earlier form of the projections 15 shown in FIGS. 20-23, the sloped entrance surface defined by the ramp-like sloped front side 70 of the projections 15 shown in FIGS. 24-27 passes beyond the top surface and the lip 63 formed between the top surface and the top of the slot 17 situated below the top surface of the adjacent tile and into its respective complementary-shaped recess or slot 17 of the adjacent tile when a downward force is exerted on the tile having the projections 15. When the flat top side 72 of the projections 15 pass the flat top wall 76*b* of the recesses or slots 17, the projections 15 are locked into place within their respective recesses or slots 17 by the projection top sides 72 engaging the slot top walls 76*b* to prevent the tiles from lifting relative to one another along their lateral sides.

FIGS. 28-31 illustrate yet a third form of the projections 15 and recesses or slots 17 of the tiles of the present invention. In these figures, it can be seen that the projections 15 have an overall arrowhead shape and include a flat top side 80 extending preferably perpendicularly outwardly from the lateral side of the tile on which the projection 15 is situated, and two sloped lateral lower sides 82*a*, 82*b* which meet at a central ridge 84 and which extend downwardly from the top flat side 80 to a point or apex A near or on the surface of the lateral side of the tile from which the projection 15 extends. The recess or slot 17 has a complementary shape to that of the projection 15, including a flat top wall 86 perpendicularly disposed to the outer surface of the lateral side of the tile, followed by two sloped lateral walls 88*a*, 88*b*.

The sloped lateral sides 82*a*, 82*b* of the projection 15 define an inverted triangular sloped entrance surface to make it easier for the projections 15 of one tile to be received by the complementary-shaped recesses or slots 17 of an adjacent tile when the tile with the projections 15 is forced downwardly in close side-by-side proximity to the adjacent tile having slots 17 situated in alignment with the projections 15. The particular shape of the projections 15, and the resiliency of the tiles and the projections 15 and recesses or slots 17, allow the tiles to be mated closely together, with the projections 15 not being sheared off or damaged when rubbing against the lateral side of an adjacent tile having the recesses or slots 17. When two adjacent tiles are mated together using a downward force on the tile having the projections 15, the sloped entrance surfaces defined by the lateral sides 82*a*, 82*b* of the projections 15 pass beyond the top surface and the lip 63 defined by the top surface and the top of the slot 17 situated below the top surface of the adjacent tile and into the respective complementary-shaped recesses or slots 17 of the adjacent tile. When the flat top side 80 of the projections 15 passes the flat top wall 86 of the recesses or slots 17, the projections 15 are locked into place within their respective recesses or slots 17 by the projection top sides 80 engaging the slot top walls 86 to prevent the tiles from lifting relative to one another along their lateral sides.

An adhesive or glue may be used between the projections 15 and the recesses or slots 17 in each of the embodiments described previously to secure the projections 15 of one tile within their aligned recesses or slots 17 of an adjacent tile.

Figure 10:
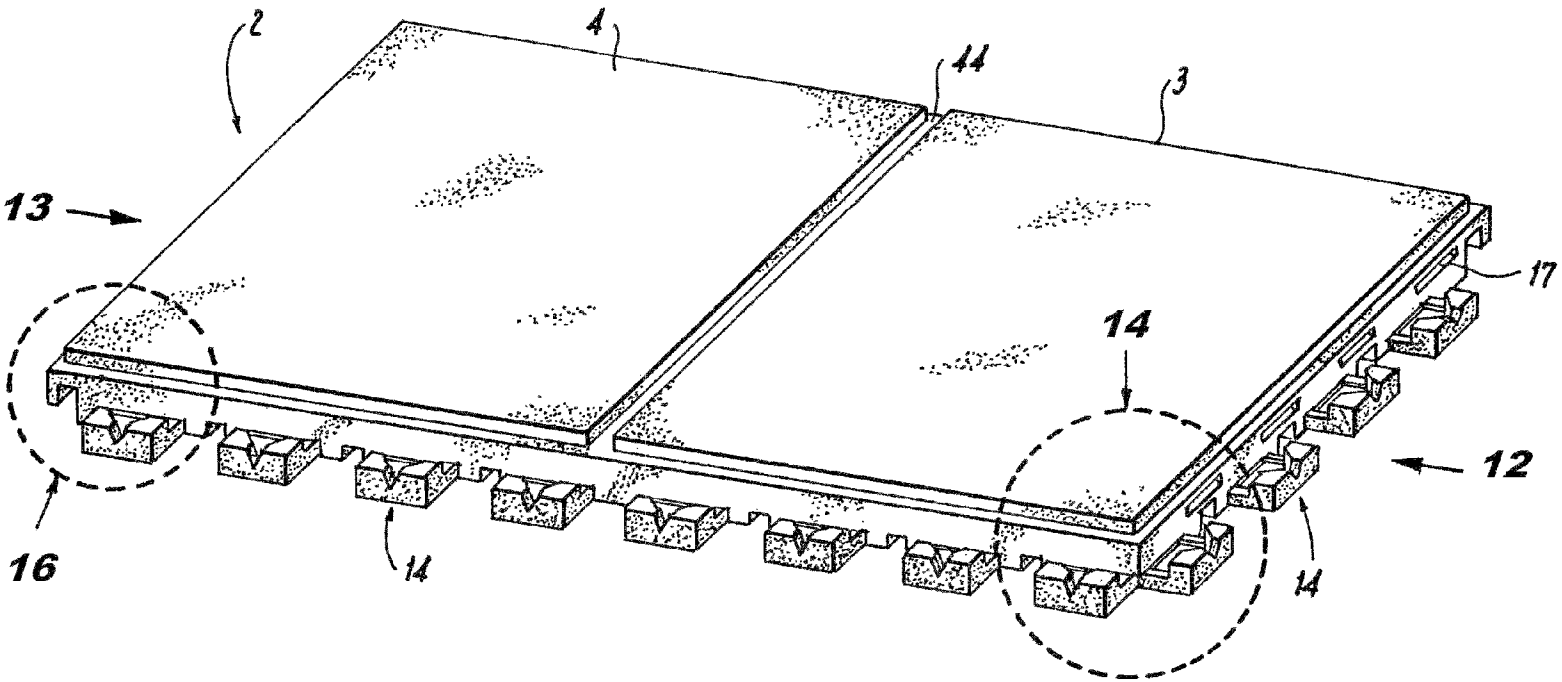
FIG. 10 is a perspective view of the tile formed in accordance with the present invention.
Figure 11:
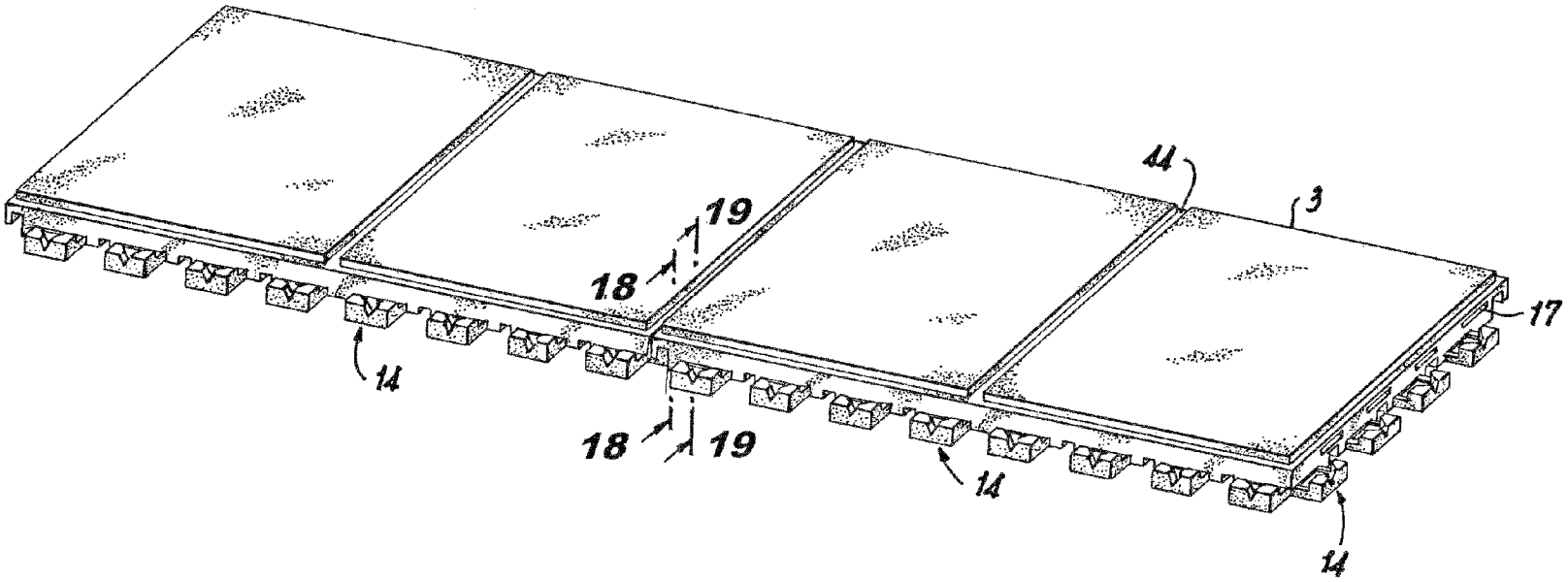
FIG. 11 is a perspective view of two tiles formed in accordance with the present invention joined together.

If the tile 2 is rectangular in shape, in that it includes two opposite shorter sides and two opposite longer sides, such as shown in FIG. 10, then it is preferred to have the two shorter sides formed with the projections 15 on one shorter side and the slots 17 on the other shorter side. It is the shorter sides of the tile that tend to curl, rather than the longer sides, and thus the projections 15 and slots 17 are most needed on the shorter sides of the tile. However, it is envisioned to be within the scope of the present invention to have all of the sides of the tile 2 formed with oppositely disposed projections 15 and slots 17. Alternatively, adjacent sides of the tile may be formed with either a plurality of projections 15 or a plurality of slots 17, or each of one or more sides of the tile may include an alternating or mixed pattern of projections 15 and slots 17.

Individual rubber tiles 2 may also be joined together by cooperatively mating the male connectors 14 on the first and second lateral sides of a first tile 2 with the female receptacles 16 on the third and fourth lateral sides of a second tile. Furthermore, the projections 15 of one tile 2 also cooperatively mate with the slots 17 of a second tile 2. The mating of the projections 15 and the slots 17 strengthens the connection between the first and second tiles 2. The engagement of the projections 15 and slots 17 also reduces the tendency of the lateral sides of the tile to curl upwardly or separate and helps maintain the top surfaces 4 of the joined together tiles in a common plane.

Figure 14:
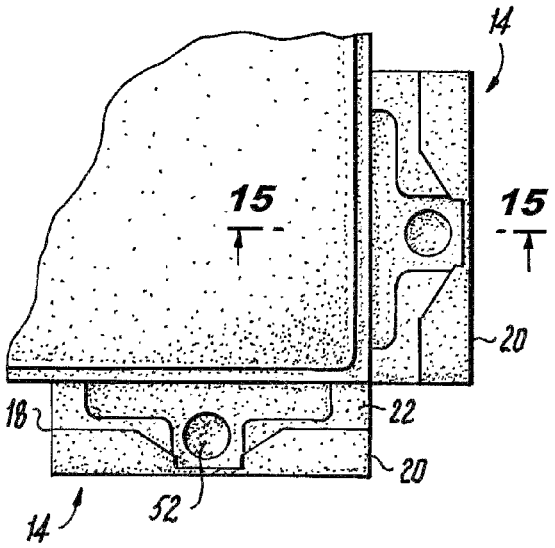
FIG. 14 is a top plan view of a corner portion of the tile of the present invention shown encircled in FIG. 10 by the broken line circle indicated by arrowed line 14.
Figure 15:
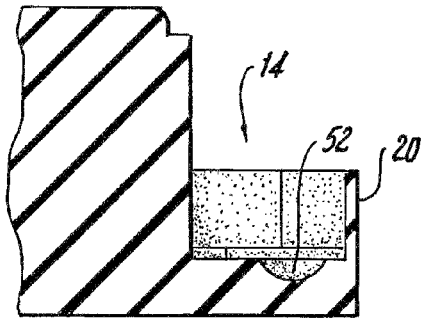
FIG. 15 is a cross-sectional view of the male connector of the tile of the present invention shown in FIG. 10, taken along line 15-15 of FIG. 14.
Figure 16:
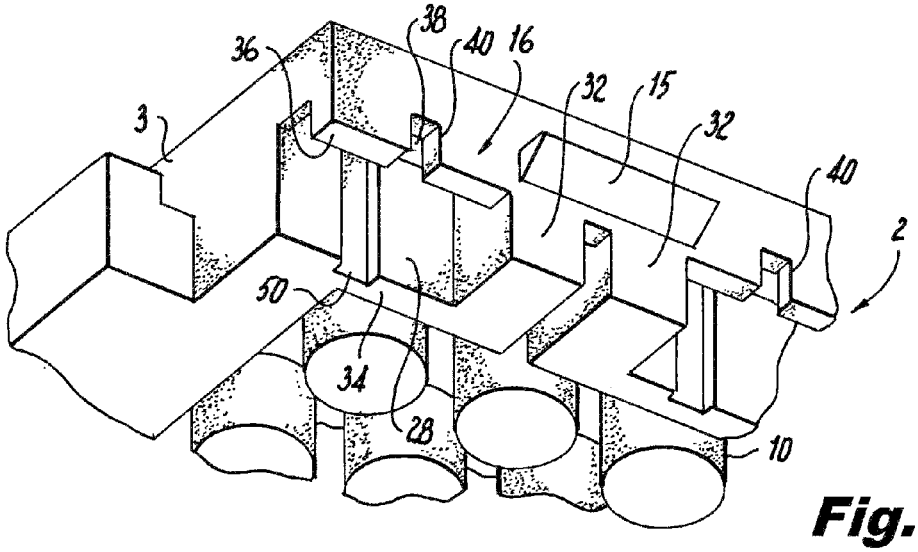
FIG. 16 is a perspective view of a portion of the underside of the tile formed in accordance with the present invention shown encircled in FIG. 10 by the broken line circle indicated by arrowed line 16, and illustrating an excess glue channel communicating with a female receptacle of the tile.
Figure 17:
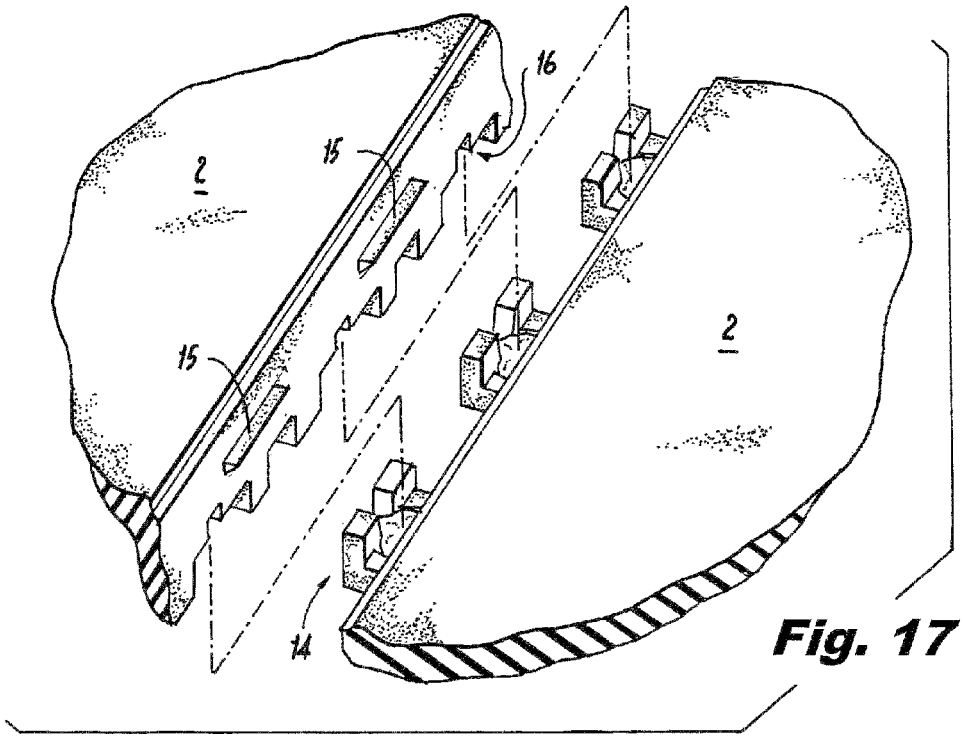
FIG. 17 is an exploded perspective view of portions of two adjacent tiles formed in accordance with the present invention, and illustrating the joining of the two tiles together.
Figure 18:
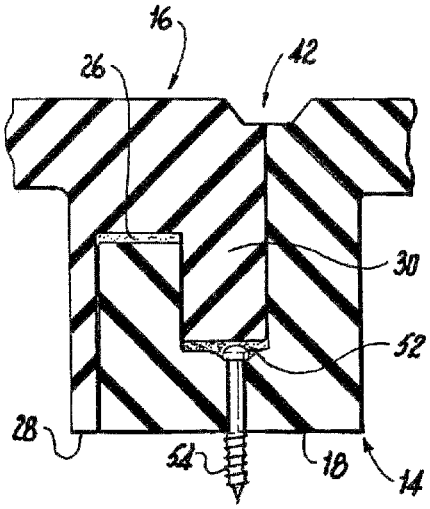
FIG. 18 is a cross-sectional view of portions of two joined together tiles formed in accordance with the present invention, taken along line 18-18 of FIG. 11.
Figure 19:
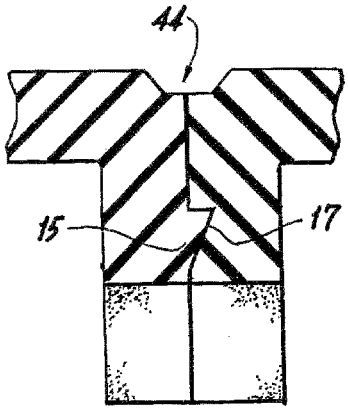
FIG. 19 is another cross-sectional view of portions of two joined together tiles formed in accordance with the present invention, taken along line 19-19 of FIG. 11.
Figure 21:
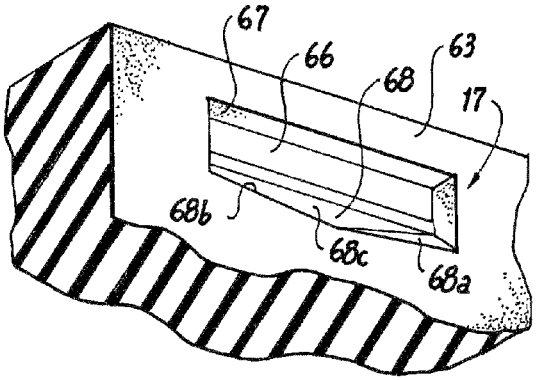
FIG. 21 is a perspective view of a portion of the tile formed in accordance with the present invention and showing a first form of a slot formed thereon for receiving the tile projection shown in FIG. 20.
Figure 20:
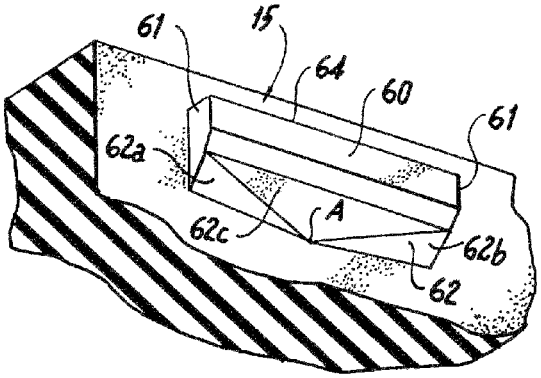
FIG. 20 is a perspective view of a portion of the tile formed in accordance with the present invention and showing a first form of a projection formed thereon for preventing curling of a lateral side of the tile.

It is also envisioned to be within the scope of the present invention to fasten the tiles 2 to a supporting surface, such as asphalt or wood, by using screws or other fasteners 54 which pass through the thickness of the male connectors 14 preferably at the horizontal first segments 18 thereof and into the supporting surface, with or without the use of liquid adhesive between mating tiles 2. For this purpose, a countersunk recess 52 may be formed in the glue reservoir 24 of the horizontal first segment 18 of one or more male connectors 14 to facilitate locating where the screw or fastener 54 should be placed, as shown in FIGS. 14, 15 and 18.

The tiles 2 formed in accordance with the present invention may be formed from reprocessed or recycled rubber, for example, from shredded or pulverized rubber automobile tires. In another form of the present invention, a top layer or portion of each tile may be formed from EPDM (ephylene propylene diene monomer) granules or shredded or pulverized white, gray or yellow (i.e., light colored) rubber tires, such as those found on forklifts and other rubber wheeled equipment. This lighter colored top layer of the tile may be about one-half (½) inch in thickness, and the remainder bottom portion of the tile may be black and made from shredded or pulverized conventional black walled automobile tires. Tiles formed with such a lighter colored top layer may be about twenty percent (20%) cooler, or more, on its top surface than tiles formed completely from conventional black walled automobile tires.

The interlocking rubber tiles are described herein as being particularly useful for playgrounds. However, it should be realized that the tiles have many different uses, including, for example, for covering rooftop surfaces and other athletic and recreational surfaces.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A tile for covering an area and which interlocks with an adjacent tile, which comprises:

a main body having a top surface and a bottom surface disposed opposite the top surface, the main body having at least a first lateral side and a second lateral side, each of the at least first lateral side and the second lateral side having an outer surface;

at least one male connector situated on at least one of the first lateral side and the second lateral side of the main body;

at least one female receptacle situated on at least one of the first lateral side and the second lateral side of the main body;

at least one projection situated on at least one of the first lateral side and the second lateral side of the main body;

wherein the at least one projection includes an upper portion and a lower portion disposed opposite the upper portion, at least the lower portion of the at least one projection having a sloped entrance surface, the upper portion of the at least one projection having a flat top side extending outwardly from the at least one of the first lateral side and the second lateral side of the main body on which the at least one projection is situated and defining an outermost edge;

wherein at least one of the first lateral side and the second lateral side of the main body having formed therein at least one slot, the at least one slot being defined by a flat top wall extending inwardly of the at least one of the first lateral side and the second lateral side of the main body in which the at least one slot is formed;

wherein the male connector of the tile is engageable with a female receptacle of an adjacent tile so that the tile may interlock with the adjacent tile;

wherein the main body of the tile has a top surface which resides generally in a plane, the sloped entrance surface of the at least one projection includes at least a portion thereof having an inverted triangular shape or defines an inverted ramp-like shape; and wherein, when a downward force is exerted on one tile having the at least one projection situated thereon, the sloped entrance surface of the at least one projection may pass beyond the top surface of an adjacent tile and into a respective at least one slot of the adjacent tile such that the flat top side of the at least one projection of the tile engages the flat top wall of the at least one slot of the adjacent tile, whereby the at least one projection of one tile is locked into place within a respective at least one slot of the adjacent tile to help prevent the tiles from lifting relative to one another along their lateral sides.

2. A tile for covering an area and which interlocks with an adjacent tile as defined by claim 1, wherein the at least one projection includes a sloping front side, a sloping first lateral side and a sloping second lateral side situated opposite the sloping first lateral side, the sloping front side, the sloping first lateral side and the sloping second lateral side converging to an apex of the inverted triangular shape, the apex being situated in proximity to the outer surface of the at least one of the first lateral side and the second lateral side of the main body on which the at least one projection is situated.

3. A tile for covering an area and which interlocks with an adjacent tile as defined by claim 1, wherein the at least one projection includes a sloping first lateral side and a sloping second lateral side, the sloping first lateral side being joined to the sloping second lateral side to define a ridge, the sloping first lateral side and the sloping second lateral side converging to an apex of the inverted triangular shape situated near the outer surface of the at least one of the first lateral side and the second lateral side of the main body on which the at least one projection is situated.

4. A tile for covering an area and which interlocks with an adjacent tile as defined by claim 1, wherein the at least one projection includes a sloping front side, the sloping front side extending from the outermost edge of the flat top side of the projection in a direction inwardly toward the outer surface of the at least one of the first lateral side and the second lateral side of the main body on which the at least one projection is situated, the sloping front side defining the sloped entrance surface of the at least one projection.

5. A tile for covering an area and which interlocks with an adjacent tile as defined by claim 1, wherein the top surface of the main body of the tile has formed therein at least one recess, the at least one recess defining a water channel through which water may flow.

6. A tile for covering an area which interlocks with an adjacent tile as defined by claim 1, wherein the main body of the tile includes peripheral edges situated at the top surface thereof, the peripheral edges being beveled to form chamfers, the chamfer of one peripheral edge of the tile being situated in parallel with and adjacent to the chamfer of a peripheral edge of an adjacent tile so as to define together a water channel through which water may flow.

7. A tile for covering an area and which interlocks with an adjacent tile as defined by claim 1, wherein the main body includes a plurality of the male connectors situated on the at least one of the first lateral side and the second lateral side of the main body, the male connectors being spaced apart from each other;

wherein the main body includes a plurality of the female receptacles situated on the at least one of the first lateral side and the second lateral side of the main body, the female receptacles being spaced apart from each other;

wherein the at least one of the first lateral side and the second lateral side of the main body has formed therein a plurality of the slots, a respective slot of the plurality of slots being situated between either a pair of spaced apart male connectors which are adjacent to each other or a pair of spaced apart female receptacles which are adjacent to each other; and wherein the at least one of the first lateral side and the second lateral side of the main body has formed therein a plurality of the projections, a respective projection of the plurality of projections being situated between either a pair of spaced apart female receptacles which are adjacent to each other or a pair of spaced apart male connectors which are adjacent to each other.

8. A tile for covering an area and which interlocks with an adjacent tile as defined by claim 1, wherein the female receptacle defines a glue reservoir for receiving a glue for adhesively joining the tile to an adjacent tile; and wherein the female receptacle has an inner wall having formed therein a channel, the channel being in communication with the glue reservoir formed in the female receptacle and extending from the glue reservoir in a direction toward the bottom surface of the main body of the tile.

9. A tile for covering an area and which interlocks with an adjacent tile as defined by claim 1, wherein the male connector further includes a first segment extending outwardly from the main body generally co-planarly with the main body, and a recess formed in the first segment thereof, the recess being provided for locating a fastener in the first segment of the male connector to secure the tile to a supporting substrate.

* * * * *